US005676213A

United States Patent [19]

Auzerais et al.

[11] Patent Number: 5,676,213

[45] Date of Patent: Oct. 14, 1997

[54] METHOD AND APPARATUS FOR REMOVING MUDCAKE FROM BOREHOLE WALLS

[75] Inventors: François M. Auzerais, Ridgefield; Kenneth K. Liang, New Milford, both of Conn.

[73] Assignee: Schlumberger Technology Corporation, Ridgefield, Conn.

[21] Appl. No.: 630,739

[22] Filed: Apr. 10, 1996

[51] Int. Cl.[6] ..... E21B 49/08; E21B 28/00

[52] U.S. Cl. ..... 175/58; 175/59; 166/177.2; 166/177.6

[58] Field of Search ..... 166/177.2, 177.6, 166/307, 249, 250.01, 250.02; 250/254, 255; 175/58, 59

[56] References Cited

U.S. PATENT DOCUMENTS

| | | | |
|---|---|---|---|
| 3,586,858 | 6/1971 | Youmans | 250/83.1 |
| 4,345,650 | 8/1982 | Wesley | 166/177.2 X |
| 4,702,315 | 10/1987 | Bodine | 166/177.2 X |
| 4,941,350 | 7/1990 | Schneider | 73/155 |
| 4,970,695 | 11/1990 | Huau | 367/13 |
| 5,363,931 | 11/1994 | Moriarty | 175/325.5 |
| 5,397,893 | 3/1995 | Minette | 250/254 |
| 5,595,243 | 1/1997 | Maki, Jr. et al. | 166/177.2 |
| 5,602,334 | 2/1997 | Proett et al. | 73/152.05 |

FOREIGN PATENT DOCUMENTS

| | | | |
|---|---|---|---|
| 0 697 501 A2 | 2/1996 | European Pat. Off. | E21B 49/00 |
| 0 699 819 A2 | 3/1996 | European Pat. Off. | E21B 33/127 |

OTHER PUBLICATIONS

Widener, M. Ward, "*The Development of High-Efficiency Narrow-Band Transducers and Arrays,*" *Journal of Acoustical Society of America,* vol. 67, No., 3 (Mar. 1980), pp. 1052–1057.

"*The Development of a Deep Submergence, Air-backed Transder,*" *Journal Acoustical Society of America*: Technical Notes and Research Briefs, vol. 80, No. 6 (Dec. 1986), pp. 1852–1853.

Venkitaraman, Adinathan, et al. "*Ultrasonic Removal of Near-Wellbore Damage Caused by Fines and Mud Solids,*" *SPE Drilling & Completion,* Sep. 1995, pp. 193–195.

*Primary Examiner*—Frank Tsay

*Attorney, Agent, or Firm*—Leonard W. Pojunas; Keith G. W. Smith

[57] ABSTRACT

A portion of a borehole wall is isolated from surrounding borehole fluids by placing a chamber of a borehole tool against the borehole wall. The chamber comprises a cylindrical recess in an exterior surface of the borehole tool. The recess is open at one end to receive borehole fluids, and closed at the opposite end by a concave ultrasonic acoustic transducer. Mudcake present within the chamber and on the isolated portion of the borehole wall is disintegrated by the concave ultrasonic transducer. This approach can be used to remove mudcake from a borehole wall with a moving or stationary borehole tool.

20 Claims, 2 Drawing Sheets

METHOD AND APPARATUS FOR REMOVING MUDCAKE FROM BOREHOLE WALLS

FIELD OF THE INVENTION

The invention relates to the evaluation of earth formations. More specifically, the invention relates to removing mudcake from a wall of a borehole in an earth formation.

U.S. patent application Ser. No. 08/632,370 filed the same day as this application describes a METHOD AND APPARATUS FOR MEASURING FORMATION PRESSURE by Auzerais.

BACKGROUND OF THE INVENTION

As a drill bit cuts into an earth formation during drilling operations, drilling muds are pumped through the resulting borehole. The drilling muds are pumped down through the center of a drill stem and collar carrying the drill bit, out through the drill bit, and up along the borehole wall. The drilling muds carry formation cuttings made by the drill bit to the surface. As the mud column circulates, solid particles within the mud accumulate on the walls of the borehole forming a mudcake provided the borehole pressure is greater than the formation pressure. Particularly, particles of the drilling muds invade the formation during drilling, blocking flow channels and reducing permeability. Blocked flow channels and reduced permeability effect production of the oil or gas from the formation. Normally, fracturing, acidizing, injection, and perforating techniques are used to open the blocked flow channels to enhance production of the oil or gas to the surface.

Venkitaraman, et al. have proposed removing damage from core samples in a laboratory setting in their paper "Ultrasonic Removal of Near-Wellbore Damage Caused by Fines and Mud Solids," *Society of Petroleum Engineers, Drilling and Completion,* September, 1995, Pages 193–197. The paper proposes this technique as a one which "may be implemented as a wireline-deployable tool, which may be used in conjunction with or as an alternative to acidizing," to possibly enhance production. According to the Venkitaraman, et al. paper, "when a core holder is placed in a vertical position, it is possible to sonicate the core with a high-powered acoustic horn." However, though the device may function in the laboratory, there is no discussion concerning how the device of this paper would be applied to a borehole wall, especially when a borehole wall cannot be placed in the vertical position. Also, the Venkitaraman, et al. paper is silent concerning how their acoustic horn could be powered to receive the high-power it needs (20–250 W/m$^2$) to operate within the borehole. Power is at a premium for such wireline tools. Usually, only 200 watts are often only available for the entire operation of a tool on a continuous mode.

SUMMARY OF THE INVENTION

The invention concerns an apparatus and method for use in treating an earth formation from within a borehole. In one embodiment, a portion of the borehole wall is isolated from surrounding borehole fluids by a chamber of a borehole tool. The chamber is opened at a first end such that the chamber contains fluid and mudcake adjacent the borehole wall. The chamber is at least partially closed at a second end by an acoustic transducer for producing a spherically focused acoustic beam. The acoustic beam fluidizes the mudcake within the chamber. A characteristic of the isolated portion is determined and a corresponding signal is produced. An earth formation is evaluated based on the produced signal.

In another embodiment, a portion of a borehole wall is isolated from surrounding borehole fluids by placing an open chamber against the borehole wall to enclose borehole fluids and mudcake. An acoustic transducer defines a portion of the chamber. Mudcake present on the isolated portion of the borehole wall is moved into fluid suspension by the acoustic transducer to remove the mudcake.

Preferably, a spherically shaped ultrasonic transducer defines the chamber and vibrates to disintegrate or fluidize the mudcake. There is little need to compensate for the presence of mudcake in measuring earth formation characteristics. This approach can be used with a moving or stationary borehole tool, as discussed below.

DETAILED DESCRIPTION OF THE INVENTION

U.S. patent application Ser. No. 08/632,370 describes a METHOD AND APPARATUS FOR MEASURING FORMATION PRESSURE by Auzerais. That application describes one environment of the present invention. According to Ser. No. (60.1264), generally, a portion of a borehole wall is isolated from surrounding borehole fluids by placing a chamber of a borehole tool. Mudcake present on the isolated portion of the borehole wall is fluidized by an ultrasonic transducer within the chamber. A pressure gauge measures pressure of the chamber to directly indicate pressure of the earth formation while moving or stationary. The disclosure of U.S. Ser. No. 08/632,370 is incorporated by reference.

It is known that mudcake forms along a wellbore wall during drilling operations. As drilling muds are pumped through the well to carry formation cuttings to the surface, particles in the mud accumulate along the wellbore wall forming the mudcake. This mudcake inhibits measurements of the earth formation surrounding the wellbore. For example, mudcake inhibits microresistivity, optical and acoustic measurements of the wellbore wall.

In addition, mudcake along a borehole wall creates "standoff." Standoff is the distance a wireline tool is kept from the face of the formation corresponding to the thickness of the mudcake. This standoff affects measurements made by the wireline tool as it is winched to the earth's surface while logging parameters of the formation as a function of depth. Typically, a wireline tool, for example, includes a means to correct for standoff, such as a compensating second measurement or interpretation processing technique. The inventors have realized an approach for dissolving mudcake, making standoff correction unnecessary for nuclear and electromagnetic logging tools.

Figure 1:
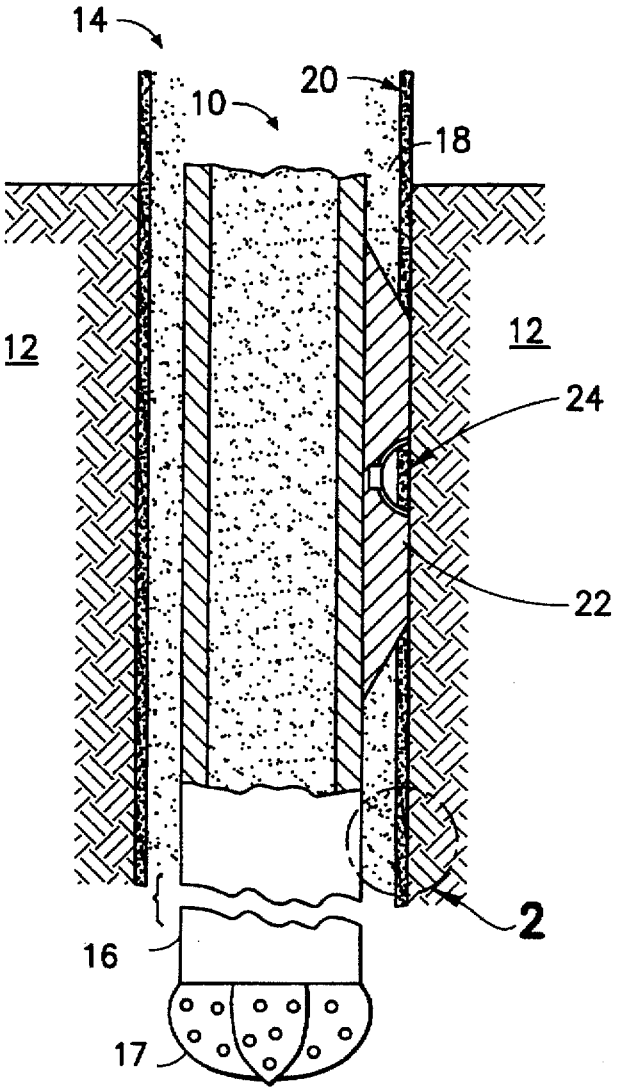
FIGS. 1 and 3 are schematic drawings of a tool for use in treating earth formations from within a borehole.
Figure 2:
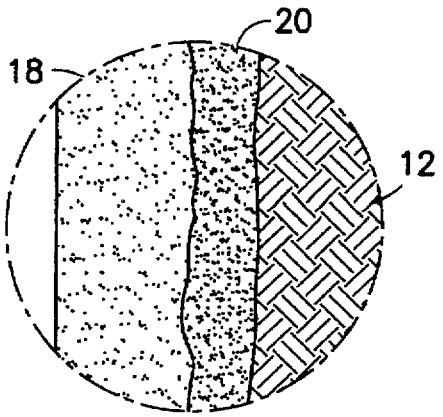
FIG. 2 illustrates mud column fluids, mudcake, and an earth formation.

FIGS. 1 and 2 are schematic drawings of a tool 10 for evaluating earth formations 12 in a borehole 14. A logging-(or measuring)-while-drilling version of the tool 10 enters the borehole 14 as part of a drill stem 16 behind a drill bit 17 which bores into the earth formation 12. Such logging-while-drilling tool logs data representing characteristics of the formation as a function of depth. The drill stem 16 or a drill collar, which holds the drill bit 17, comprise a housing of the tool 10. Drilling muds form a mud column 18 which is pumped to circulate through the borehole 14 down through the center of the drill stem 16 and up along the borehole wall to carry cuttings of the formation to the surface. As the mud column 18 circulates, mud accumulates on the walls of the borehole 14, forming a mudcake 20. A stabilizer 22 (one shown, typical of four arranged laterally around the tool, for example) centers the tool 10 within the borehole 14. Acoustic transducer 24 (one shown, typical of any number and described below) are recessed in an outer surface of the stabilizer 22 such that acoustic transducers directly abut or engage the borehole wall while the tool 10 is moving and drilling, or idle and stationary. The acoustic transducers 24 are preferably mounted on an exterior surface of a borehole tool on a structure like the stabilizer 22 which projects radially beyond the diameter of the drill stem 16 or drill collar. In this manner, the acoustic transducers 24 are more likely to engage the borehole wall. Alternatively, the acoustic transducers 24 are mounted directly on the housing of the tool 10.

FIG. 2 is an enlarged portion of FIG. 1. Mudcake 20 forms a relatively impermeable membrane between the drilling mud 18 comprising a mud column and the formation 12. Pressure in the wellbore (borehole) is high, the drilling mud 18 being under great pressure as they are pumped through the borehole 14. A pressure drop occurs across the mudcake 20 which forms a relatively impermeable membrane between the formation 12 and drilling mud 18. Pressure at the formation 12 is much lower than that of the drilling mud 20 in the borehole 14.

Figure 3:
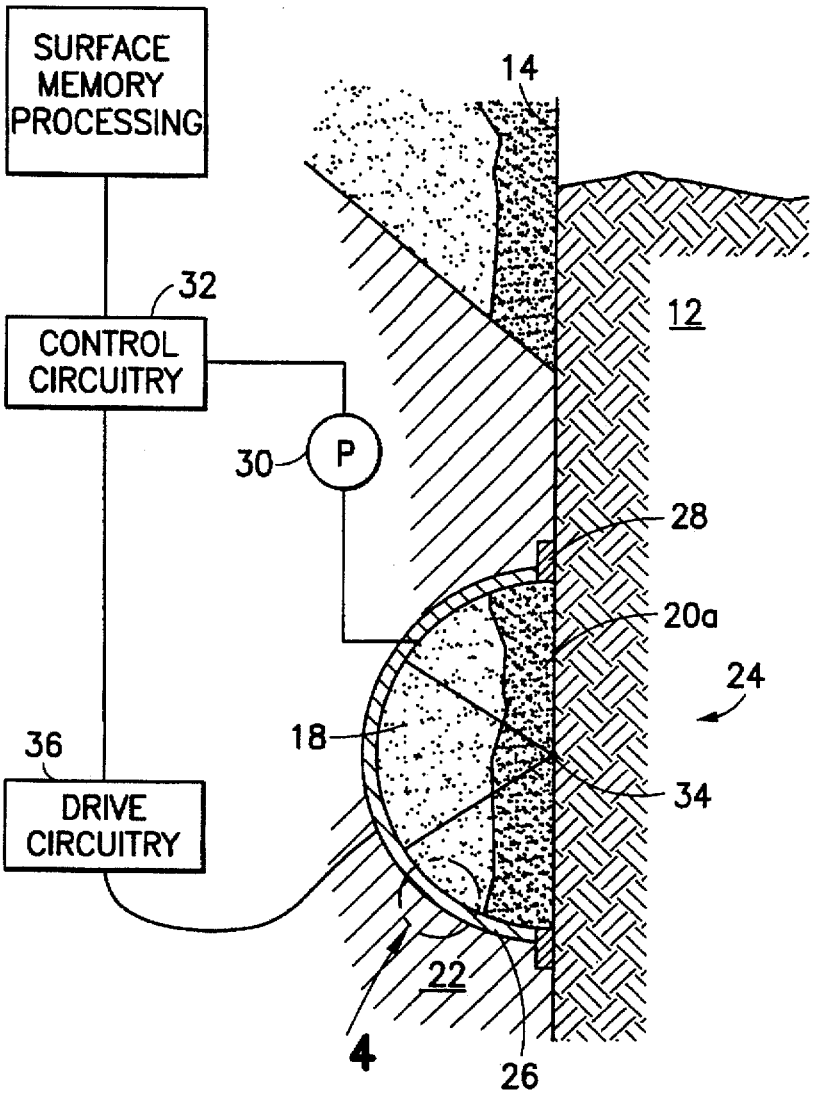

FIG. 3 is an enlarged view of a portion of FIG. 1. Acoustic transducer 24 is mounted on a stabilizer 22 which engages the formation 12 at a wall of the borehole 14. The acoustic transducer 24 comprises a cup 26 inserted in an outer surface of the stabilizer 22. The cup 26 at least partially defines a chamber. A recess cut into the outer surface of the stabilizer 22 can also define the chamber. The cup 26 also comprises a vibrating element, such as concave or a spherically shaped ultrasonic transducer. For this embodiment, a grommet 28 seals the cup 26 in place. As an example, a circumferential edge of the cup 26 is substantially flush and engages the exterior surface of the tool. Alternatively, the cup 26 can be set back from the exterior surface of the tool 10 in a deeper recess. A pressure gauge 30 connects to the chamber and control circuitry 32 to measure one formation parameter such as pressure within the chamber, if desired. Drive circuitry 36 connects to this acoustic cup 26 and includes a voltage pulser, amplifier, timing circuitry oscillator and power supply, for example.

The acoustic transducer 24 isolates a portion of the formation 12. As an example, the acoustic transducer 24 isolates a section of the borehole wall, enclosing drilling muds **18*a* and mudcake 20*a* within the chamber. The pressure in the chamber is that of the borehole 14, which is substantially above the pressure of the formation 12. However, the mudcake 20*a* forms a relatively impermeable membrane between the chamber and the formation 12, impeding evaluations of the formation and restricting fluid flow between the chamber and the formation 12. The drive circuitry 36 vibrates the acoustic cup 26 at a chosen frequency for a time period determined by the control circuitry 32. In this manner, the acoustic cup 26 emits an acoustic pulse through the drilling mud 18*a* toward the mudcake 20*a*. The acoustic pulse fluidizes the mudcake 20*a*. That is, the acoustic pulse is of sufficient intensity and frequency to vibrate or oscillate the mudcake 20*a* into fluid suspension within the drilling mud 18*a*. In addition, the cup 26 is shaped so the acoustic pulse is spherically focused to form a conical beam as indicated by the arrows. The apex of the acoustic beam is the focal point 34 of the transducer and is located toward or within the mudcake. The mudcake 20*a* fluidizes in microseconds. In effect, the mudcake "membrane" disintegrates. Because the borehole pressure is substantially above that of the formation 12, because the mudcake 20*a* is fluidized until fluid flow occurs between the chamber and the formation 12, and pressure equilibrium is reached. The pressure gauge 30 generates a signal indicating the pressure of the chamber at or near equilibrium to the control circuitry 32. This signal represents a direct measurement of formation pressure, for example. The control circuitry 32** then transmits this formation pressure signal to a memory for storage, or to the surface to be recorded as a log or for processing to evaluate a characteristic of an earth formation.

In fact, any formation parameter, such as grain size, porosity, density, resistivity, etc. could be measured with appropriate nuclear, electromagnetic, video or geoacoustic tools after the mudcake has been fluidized. The absence of mudcake at the borehole wall allows a direct evaluation of the earth formation. As an example, the acoustic transducer can initially be energized to fluidize mudcake, then energized again to ultrasonically scan the formation wall. Ultrasonic scanning of a borehole casing is described in U.S. Pat. No. 4,970,695 to Huau issued Nov. 13, 1990, which is incorporated herein by reference. The tool 10 can be pressed against while moving along the surface of the formation. Additionally "standoff" can be ultrasonically measured before and after mudcake removal.

Figure 4:
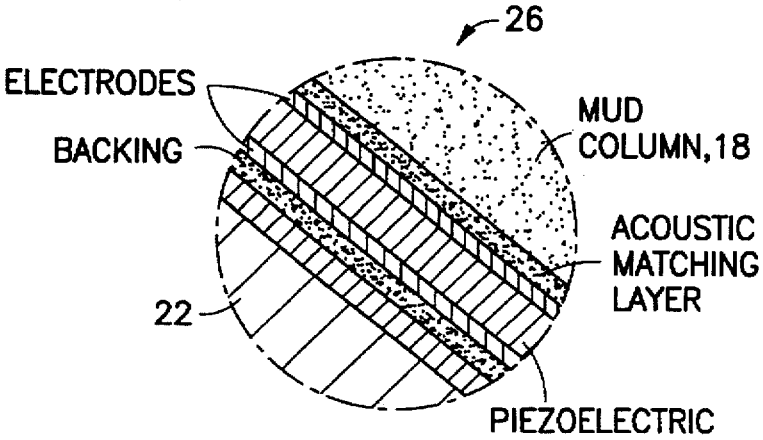
FIG. 4 is an enlargement of a portion of FIG. 3.

FIG. 4 shows an enlarged cross-sectional view of the acoustic transducer 24 of FIG. 3. The acoustic transducer 24 comprises a series of concentric layers. In one version, a piezoelectric layer, such as ceramic, is sandwiched by front and back electrodes. These two electrodes connect to the drive circuit 36 in a manner which ultrasonically vibrates the acoustic transducer 24. A front acoustic matching layer (or layers) sits atop the front electrode. The material of the front matching layer is chosen to acoustically match the piezoelectric material to the borehole fluids. Similarly a rear acoustic matching layer (or layers) sits behind the back electrode. The acoustic layers comprise polypropylene, metal, or a composition and provide a design with no acoustically matched layers. The material of the back layer is chosen to deliberately acoustically mismatch the piezoelectric material to a backing material. In this manner, acoustic energy is reflected from the mismatched layer providing a stronger acoustic pulse. Conversely, the material of the back layer is chosen to match the piezoelectric material if the acoustic transducer will also create echo ultrasonic pulses to image the formation after fluidizing the mudcake. A backing material sits behind the back acoustic matching layer. The backing material is a composite like tungsten loaded rubber, used for mounting and sealing purposes.

The cup 26 of FIGS. 3 and 4 comprises an acoustic transducer on the order of 1–2 inches in diameter. The cup 26 is designed to vibrate at 100–500 KHz. The design of the transducer involves a concave disk, chosen so acoustic energy is focused along its axis in a conical beam toward the mudcake. It is this focused acoustic energy which vibrates the mudcake into suspension within the fluid contained in the chamber. The O-ring 28 seals the cup 26 within the chamber. Stainless steel electrodes connect via wires to the driving circuitry to receive an oscillating signal from the driving circuitry.

Such ceramic, spherically focused transducers are commercially available. One source has been Precision Acoustic Devices, now ATL of Seattle, Wash.

The ultrasonic acoustic transducer operates at some distance (centimeters) from the mudcake on the borehole wall and directs a spherically focused beam towards the borehole wall. The concave, partially spherical shape of the acoustic transducer provides geometric focusing, resulting in intensity amplification along the axis of propagation as ultrasonic energy radiates from the source. Maximum intensity is attained at the focal point where the mudcake can be located to take advantage of the maximum fluidizing or destructive capability of the ultrasonic beam.

The acoustic transducer 24 can be fashioned from a buffer rod with a spherical lens or from a spherical shell of piezoelectric ceramic material, the radius of curvature of which corresponds to the focal length, and hence the working distance of the device. Thus, the location of the focal point is automatically provided by the radius and geometric curvature of the acoustic transducer. The back and front surfaces of the piezoceramic elements will be properly matched acoustically to maximize transduction efficiency, as discussed above. The entire transducer assembly can be an integral part of the probe housing. The location of the focal point is automatically provided by the radius and geometric curvature of the acoustic transducer.

Another advantage of this design is the relative insensitivity of the focal point's location to changes in fluid properties in front of the acoustic transducer when operated at sufficiently high frequencies. The low frequency limit is chosen according to the size of the transducer relative to the acoustic wavelength, which reduces the effectiveness of focusing. Approximate frequency limits are also imposed by the attenuative characteristics of the borehole liquid, which typically increases linearly with frequency by dB per unit distance. The transducer design can be ruggedized to handle a peak input power level of as much as 1 kW needed to blast through a mudcake in a short time frame (microseconds)

The diffraction limited spot size of 3 mm gives an intensity amplification of 25 dB, much higher than the typical gain obtained with mechanical concentrators at low operating frequencies. The depth of focus gives a measure of the destructive zone of the focused beam. This design example can adequately handle a 1 cm thick mudcake, the upper limit of mudcake thickness in a while-drilling environment.

A commercial transducer with similar specifications was set up in the laboratory for a simple experiment. The transducer was excited with a 30-cycle tone burst at 500 kHz with a peak amplitude of 100 volts. The repetition rate was about 2 kHz. The ultrasonic beam was focused at the bottom of a plexiglas tank containing water. The 0.25" thick plexiglas was melted through at the focal spot.

Modifications to this embodiment are apparent. The tool 10 can be either the illustrated logging-while-drilling tool or a wireline tool. A wireline version of the tool 10 can be lowered into the borehole 14 on a cable and is winched to the surface while data representing characteristics of the formation as a function of depth are logged. A housing 16 of a wireline tool 10 encloses necessary electronics to isolate them from borehole fluids the tool housing A retractable arm could extend from the housing, forcing the tool against the formation so that the recessed chamber in the exterior surface of the housing, opposite the retractable arm, isolates a portion of the formation.

We claim:

1. A method for treating an earth formation comprising:

placing a tool in a borehole in a formation;

isolating a portion of the formation by placing a chamber of the tool against a portion wall of the borehole, the chamber comprising a recess in an exterior surface of the tool; and producing acoustic energy as a spherically focused pulse within the chamber and loosening material from the borehole wall.

2. The method of claim 1, comprising:

containing borehole fluids and mudcake within the chamber.

3. The method of claim 2, comprising:

producing the acoustic energy with a generally concave transducer from one end of the chamber.

4. The method of claim 3, comprising:

activating an acoustic transducer to produce the pulse of acoustic energy such that a focal point of the pulse is located at the mudcake.

5. The method of claim 1, comprising:

producing the acoustic energy with a concave transducer from one end of the chamber.

6. Method of treating an earth formation, the steps comprising:

placing against a portion of a borehole wall of a formation, a partially spherical member recessed in an exterior surface of a borehole tool, the portion containing fluid and mudcake; and vibrating the partially spherical member such that the mudcake moves into fluid suspension at the isolated portion of the borehole wall.

7. The method of claim 6, comprising:

producing a signal with a sensor of the borehole tool representing a parameter of the formation adjacent the isolated portion of the borehole wall; and indicating an earth formation characteristic based on the produced signal.

8. The method of claim 6, the partially spherical member comprising an acoustic transducer, the steps comprising:

substantially isolating the portion of the borehole wall with the acoustic transducer.

9. The method of claim 8, generating a focused acoustic pulse with the acoustic transducer sufficient to fluidize the mudcake.

10. The method of claim 6, comprising:

generating a focused acoustic pulse against the mudcake.

11. Apparatus for treating an earth formation comprising:

a borehole tool for positioning in a borehole in an earth formation, the borehole containing fluids and material and having a wall, the borehole tool being engageable with the borehole wall;

at least one recess in the exterior surface of the borehole tool, the recess open to fluids contained in the borehole;

an acoustic transducer positioned in each recess to contact the fluids contained in the borehole, the acoustic transducer arranged to produce a spherically focused acoustic pulse through the fluids and remove material from the borehole wall.

12. The apparatus of claim 11, the acoustic transducer arranged to focus the acoustic pulse such that a focal point of the acoustic pulse is within the material as the borehole tool engages the borehole wall.

13. The apparatus of claim 12, the acoustic transducer being substantially concave.

14. The apparatus of claim 11, the acoustic transducer being substantially concave, and having an acoustic focal point in the vicinity of the exterior surface of the borehole tool.

15. The apparatus of claim 13, the acoustic transducer comprising a ceramic material, and having a circumferential edge which substantially engages the exterior surface of the borehole tool.

16. Apparatus for use in an earth formation, comprising:

a body for passage within a borehole in a formation, the borehole containing fluid and having a wall;

the body having a chamber for receiving and isolating some of the fluid; and an acoustic element substantially comprising the chamber for moving material in the chamber into suspension within the fluid.

17. The apparatus of claim 16, a cylindrical recess in the body comprising a portion of the chamber.

18. The apparatus of claim 17, the material comprising mudcake, the acoustic element comprising a concave acoustic transducer for focusing acoustic energy through the fluid toward the mudcake.

19. The apparatus of claim 16, the acoustic element having a generally concave surface substantially extending across one end of the chamber for producing conical acoustic pulse toward the material.

20. The apparatus of claim 19, the body comprising:

a portion of a borehole tool for gathering data about the formation from within the borehole.

* * * * *